US011543087B2

(12) United States Patent
Hou et al.

(10) Patent No.: US 11,543,087 B2
(45) Date of Patent: Jan. 3, 2023

(54) LIGHTING APPARATUS

(71) Applicant: XIAMEN LEEDARSON LIGHTING CO., LTD, Fujian (CN)

(72) Inventors: Shouqiang Hou, Fujian (CN); Xiaoliang Wen, Fujian (CN); Yongzhe Dong, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/068,298

(22) Filed: Oct. 12, 2020

(65) Prior Publication Data

US 2021/0108768 A1 Apr. 15, 2021

(30) Foreign Application Priority Data

Oct. 10, 2019 (CN) ..... 201921689806.0
Oct. 10, 2019 (CN) ..... 201921689990.9

(51) Int. Cl.

| | |
|---|---|
| ***F21K 9/65*** | (2016.01) |
| ***F21V 19/02*** | (2006.01) |
| ***F21V 21/34*** | (2006.01) |
| ***F21V 23/00*** | (2015.01) |
| ***F21V 21/30*** | (2006.01) |
| ***F21Y 115/10*** | (2016.01) |

(52) U.S. Cl.

CPC ..... *F21K 9/65* (2016.08); *F21V 19/02* (2013.01); *F21V 21/30* (2013.01); *F21V 21/34* (2013.01); *F21V 23/003* (2013.01); *F21Y 2115/10* (2016.08)

(58) Field of Classification Search

CPC . F21K 9/65; F21V 19/02; F21V 21/30; F21V 21/34; F21V 23/003; F21Y 2115/10

See application file for complete search history.

(56) References Cited

U.S. PATENT DOCUMENTS

| | | | | |
|---|---|---|---|---|
| 6,837,596 | B2 * | 1/2005 | Tanaka | F21V 5/008 362/277 |
| 8,215,805 | B2 * | 7/2012 | Cogliano | F21V 21/04 362/365 |
| 10,247,390 | B1 * | 4/2019 | Kopitzke, IV | F21V 14/02 |
| 11,105,496 | B1 * | 8/2021 | Huang | F21V 17/105 |
| 2007/0236931 | A1 * | 10/2007 | Chien | F21V 21/08 362/249.07 |

* cited by examiner

*Primary Examiner* — Mary Ellen Bowman
(74) *Attorney, Agent, or Firm* — Chun-Ming Shih; Lanway IPR Services

(57) ABSTRACT

A lighting apparatus includes a light source module, an internal housing, an exterior housing and a sliding track. The light source module including a LED module. The LED module may include multiple types of LED chips of different parameters that may be controlled to mix a desired parameter. The internal housing has a light opening and a protruding block. The light source module is fixed to the internal housing and a light of the LED module passes through the light opening. An exterior housing having a sliding groove. The exterior housing encloses the internal housing and allows the protruding block of the internal housing moving along the sliding groove to change a tilt angle of the light with respect to the exterior housing. The sliding track is used for the exterior housing to move along the sliding track for further adjusting an output direction of the light.

19 Claims, 14 Drawing Sheets

LIGHTING APPARATUS

FIELD

The present invention is related to a lighting apparatus, and more particularly related to a lighting apparatus with adjustable light direction.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In some embodiments, people want their lighting device capable of adjusting light direction or parameters. It is beneficial to design a lighting device convenient to be adjusted.

SUMMARY

In some embodiments, a lighting apparatus includes a light source module, an internal housing, an exterior housing and a sliding track.

The light source module including a LED module. The LED module may include multiple types of LED chips of different parameters that may be controlled to mix a desired parameter.

The internal housing has a light opening and a protruding block.

The light source module is fixed to the internal housing and a light of the LED module passes through the light opening.

The exterior housing having a sliding groove.

The exterior housing encloses the internal housing and allows the protruding block of the internal housing moving along the sliding groove to change a tilt angle of the light with respect to the exterior housing.

The sliding track is used for the exterior housing to move along the sliding track for further adjusting an output direction of the light.

In some embodiments, the exterior housing and the internal housing are semi-sphere structures.

In some embodiments, the sliding groove is a curve groove on the semi-sphere structure of the external housing.

In some embodiments, the sliding track has a segmenting structure for the external housing to move along the sliding groove segment by segment.

In some embodiments, the sliding groove has multiple segment positions for the protruding block to move and stay in one of the multiple segment positions.

In some embodiments, the sliding track is a circular track.

In some embodiments, the sliding track has a stop structure to limit a rotation angle of the exterior housing with respect to the sliding track.

In some embodiments, the light source module has a lens for guiding a light direction of the light.

In some embodiments, the lens is manually moved to adjust a relative distance between the lens and the LED module to change a beam angle of the light.

In some embodiments, the lighting apparatus may also include a reflector movable for adjusting a relative angle between the light source and the internal housing.

In some embodiments, there is a hinge connecting the internal housing and the exterior housing for the internal housing to rotate with respect to the exterior housing.

In some embodiments, the hinge has a rotating shaft moving upon the sliding track.

In some embodiments, a camera module is attached to the internal housing.

In some embodiments, an optical sensor coupled to the light source for receiving an ambient optical parameter to dynamically adjust the light of the LED module.

In some embodiments, the light source module has a light beam source for emitting a light beam and a diffusion source for emitting a diffusion light.

In some embodiments, the sliding track emits a diffusing light.

In some embodiments, a timer is coupled to the light source module to adjust the light according to a time of the timer.

In some embodiments, the protruding block has a circular wall.

In some embodiments, a driver module is located inside the circular wall.

In some embodiments, the driver module has a driver box plugged to the circular wall.

DETAILED DESCRIPTION

Figure 14:
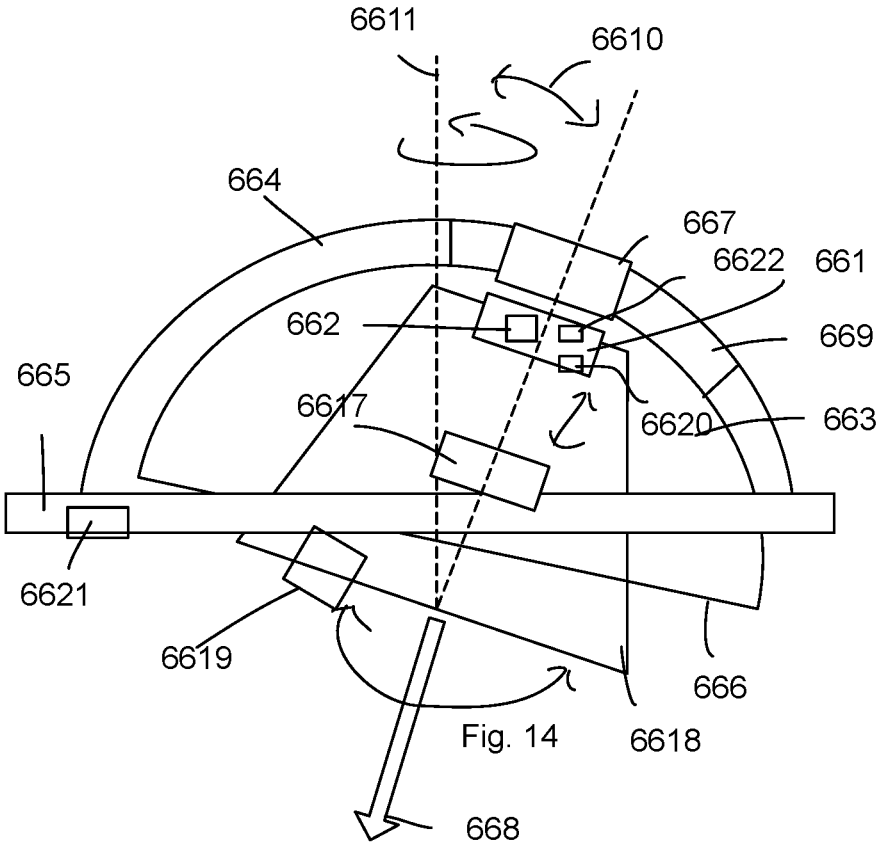
FIG. 14 shows an embodiment.
Figure 15:
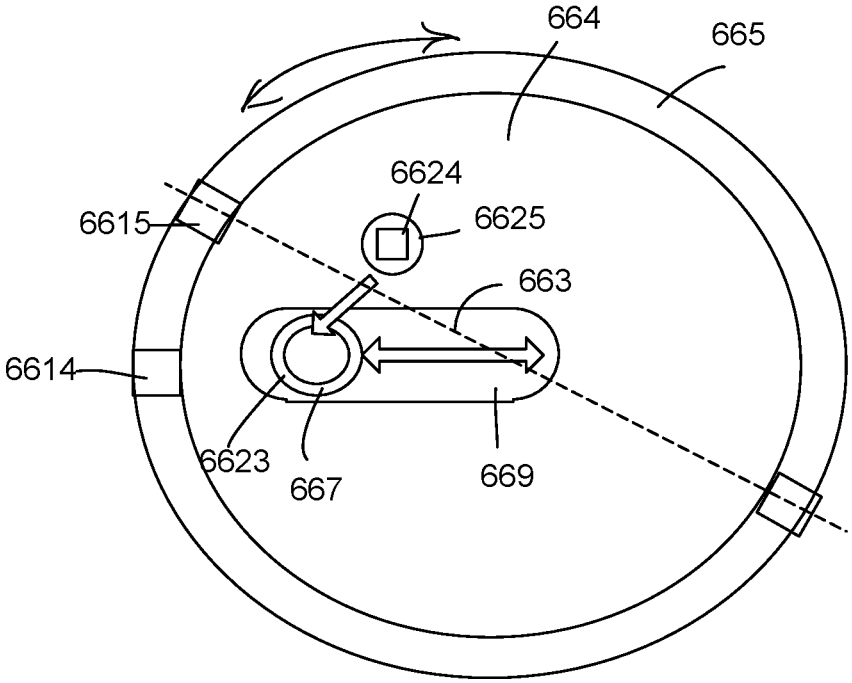
FIG. 15 shows another view of the example in FIG. 14.

Please refer to FIG. 14 and FIG. 15, which illustrates an embodiment. FIG. 14 shows a side view while FIG. 15 shows a top view. The same reference numerals refer to the same components. In FIG. 14, a lighting apparatus includes a light source module 661, an internal housing 663, an exterior housing 664 and a sliding track 665.

The light source module 661 including a LED module 662. The LED module 661 may include multiple types of LED chips of different parameters that may be controlled to mix a desired parameter.

The internal housing 663 has a light opening 666 and a protruding block 667.

The light source module 661 is fixed to the internal housing 663 and a light 668 of the LED module 662 passes through the light opening 666.

The exterior housing 664 having a sliding groove 669.

The exterior housing 664 encloses the internal housing 663 and allows the protruding block 667 of the internal housing 663 moving along the sliding groove 669 to change a tilt angle 6610 of the light 668 with respect to the exterior housing 664.

The sliding track 665 is used for the exterior housing 664 to move along the sliding track 665 for further adjusting an output direction of the light, e.g. a rotation along the central axis 6611.

In some embodiments, the exterior housing 664 and the internal housing 663 are semi-sphere structures.

In some embodiments, the sliding groove 665 is a curve groove on the semi-sphere structure of the external housing.

In some embodiments, the sliding track 665 has a segmenting structure for the external housing to move along the sliding groove segment by segment.

Figure 16:
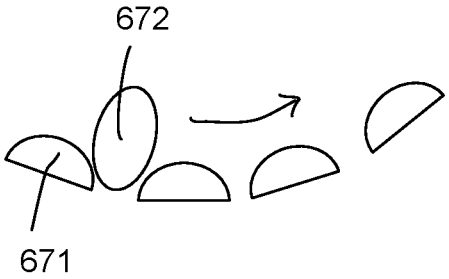
FIG. 16 shows a jigged structure for providing a segment movement.

Please see FIG. 16. For example, the exterior housing has an elastic block 672 which is held by a segmenting structure, e.g. a jagged structure 671, for keeping the movement of the exterior housing with respect to the sliding track in a segment by segment manner.

In some embodiments, the sliding groove has multiple segment positions for the protruding block to move and stay in one of the multiple segment positions. This may be implemented similarly as the sliding track with the example in FIG. 16. But other designs may also be used for providing such segmented movement.

In some embodiments, the sliding track is a circular track.

In some embodiments, the sliding track has a stop structure 6614 to limit a rotation angle of the exterior housing 664 with respect to the sliding track 665. The exterior housing may have a hinge 6615 stopped by the stop structure 6614 when the rotation angle is over a limiting angle, e.g. 180 degrees.

In some embodiments, the light source module has a lens 6617 for guiding a light direction of the light.

In some embodiments, the lens 6617 is manually moved to adjust a relative distance between the lens and the LED module 662 to change a beam angle of the light.

For example, the lens may be fixed to a tube that is connected to another tube so as to provide a movement to get closer or get farther with respect to the LED module.

In some embodiments, the lighting apparatus may also include a reflector 6618 movable for adjusting a relative angle between the light source and the internal housing 663. For example, a rotation hinge may be used for fixing the reflector to the internal housing 663 so as to change the relative angle between the internal housing and the reflector 6618.

In some embodiments, there is a hinge 6615 connecting the internal housing 663 and the exterior housing 664 for the internal housing 663 to rotate with respect to the exterior housing 664.

Figure 2:
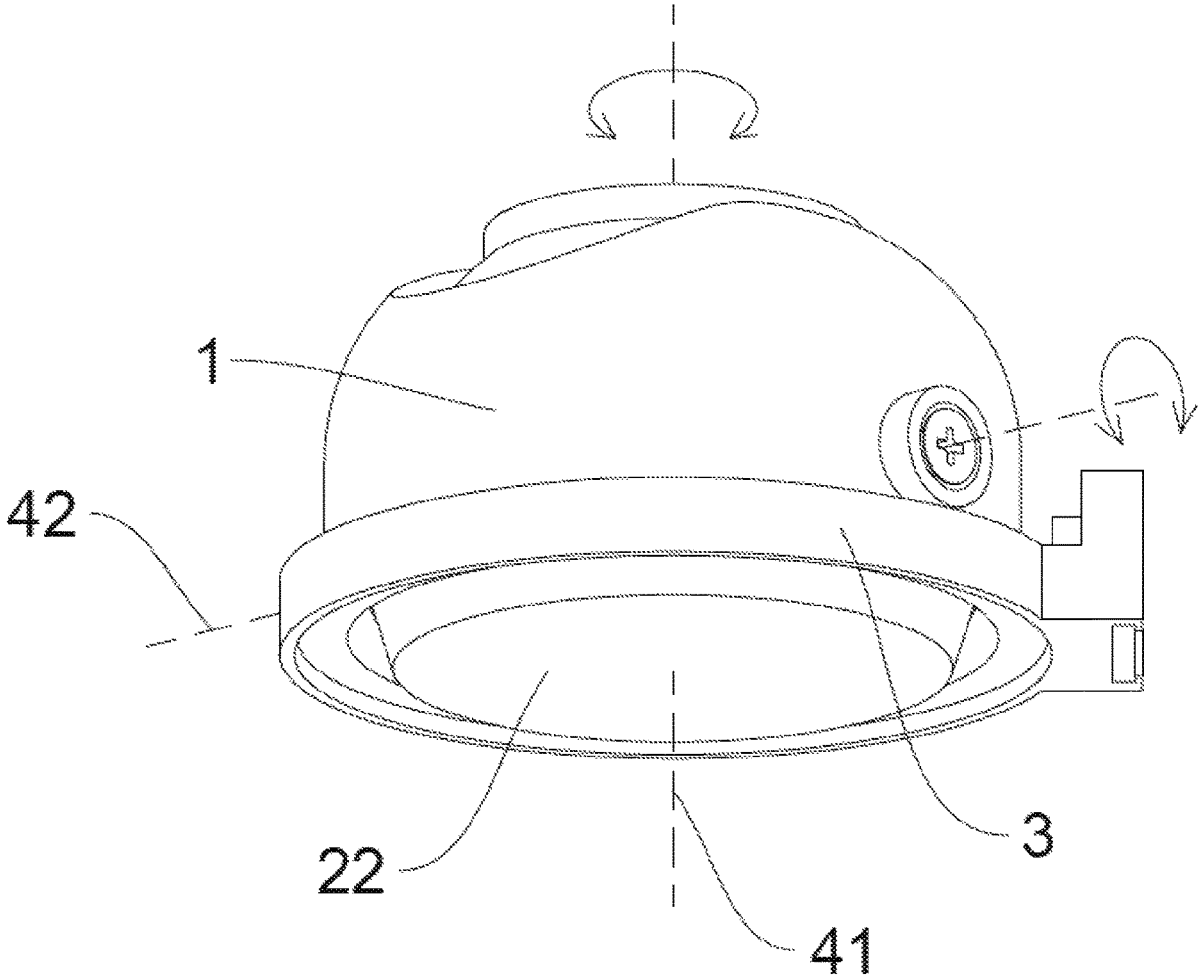
FIG. 2 illustrates another view of the example in FIG. 1.

In some embodiments, the hinge 6615 has a rotating shaft, e.g. a protruding circular block, moving upon the sliding track, e.g. the example shown in FIG. 2.

In some embodiments, a camera module 6619 is attached to the internal housing 663. Such camera 6619 may share the same driver that provides a driving current to the LED module 661.

In some embodiments, an optical sensor 6620 coupled to the light source for receiving an ambient optical parameter to dynamically adjust the light of the LED module.

In some embodiments, the light source module has a light beam source 6621 for emitting a light beam and a diffusion source, e.g. using the LED module 662, for emitting a diffusion light.

In some embodiments, the sliding track emits a diffusing light, e.g. using a light guide made of plastic material with many light escape dots using the diffusion source 6621.

In some embodiments, a timer 6622 is coupled to the light source module to adjust the light according to a time of the timer.

In some embodiments, the protruding block has a circular wall 6623.

In some embodiments, a driver module 6624 is located inside the circular wall 6623.

In some embodiments, the driver module 6624 has a driver box 6625 plugged to the circular wall 6623.

In following description, same reference numerals refer to the same components and are not repeated again for brevity.

Figure 1:
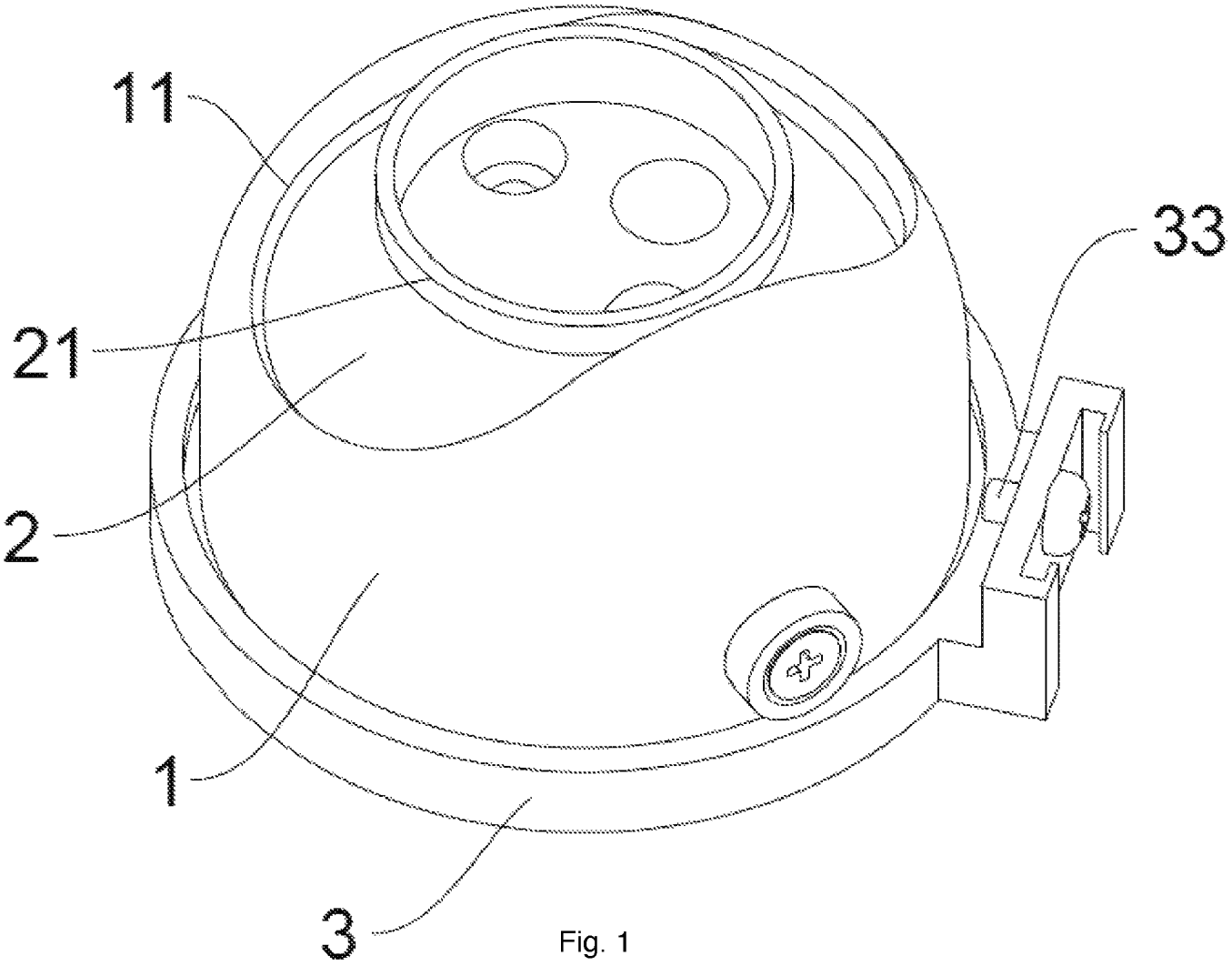
FIG. 1 illustrates a lighting apparatus embodiment.

Please refer to FIG. 1. In FIG. 1, a lighting apparatus has an exterior housing 1 and an internal housing 2. The exterior housing 1 and the internal housing 2 are semi-sphere structures.

There is a sliding groove 11 on the exterior housing 1 for a protruding block 21 to move along the sliding groove. There is a stop structure 33 for limiting a rotation of the exterior housing 1 along a sliding track 3.

Please refer to FIG. 2, which further shows another view of the example in FIG. 1. The internal housing 2 is manually moved with respect to the exterior housing 1 along a rotation axis 42. In addition, the exterior housing 1 is moved along the sliding track 3 along a rotation axis 41. The light opening 22 allows a light of a light source module fixed to the internal housing to pass through.

Figure 3:
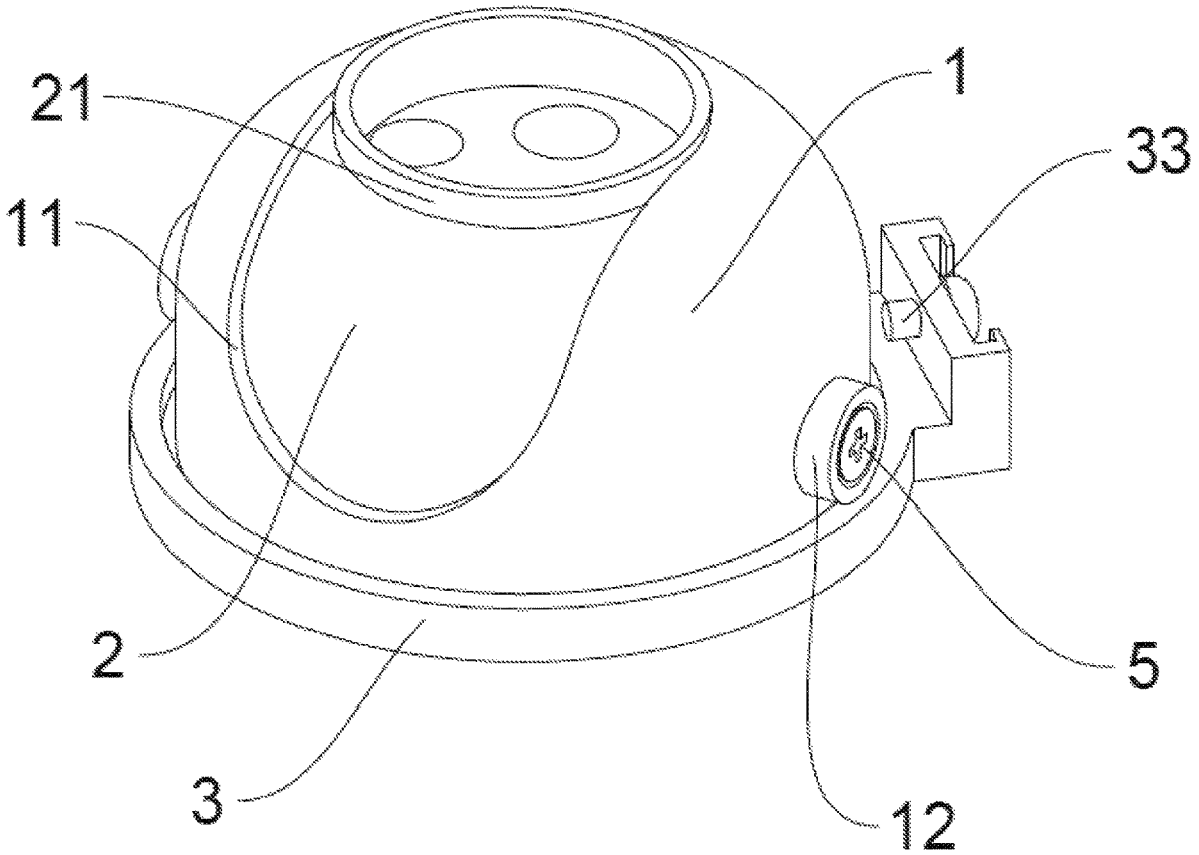
FIG. 3 illustrates another lighting apparatus embodiment.

Please refer to FIG. 3, which shows further details of the example in FIG. 1. In FIG. 3, there is a hinge 5 for connecting the exterior housing 1 and the internal housing 2 for the internal housing 2 to rotate with respect to the exterior housing 1.

Figure 4:
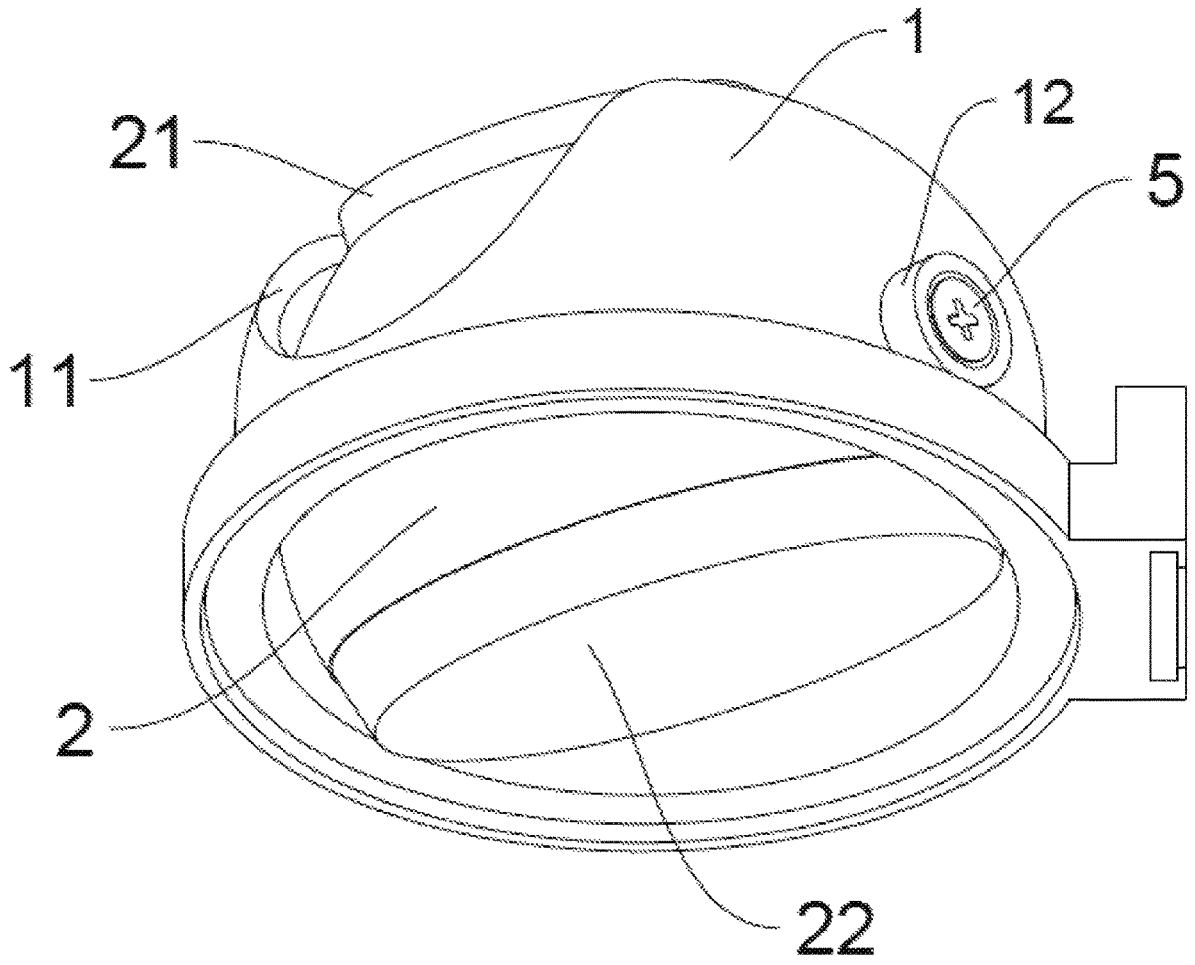
FIG. 4 illustrates a movement example of the lighting apparatus.

Please refer to FIG. 4, which shows another view of the example in FIG. 1. In FIG. 4, the block 12 of the hinge 5 is also used for the exterior housing to move along the sliding track.

Figure 5:
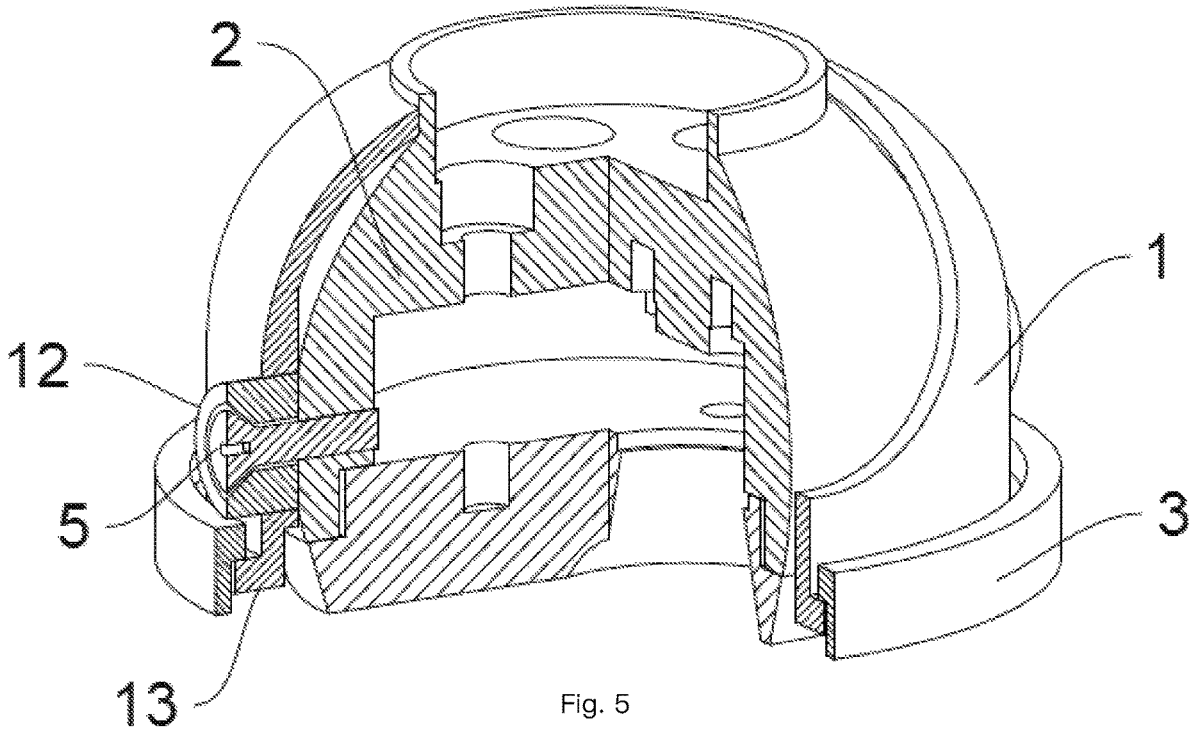
FIG. 5 illustrates a cross sectional view of components in the lighting apparatus example.

Please refer to FIG. 5, which shows an inner structure of components in the example of FIG. 1. There is a block bring 13 together with the hinge to limit the exterior housing to move along the sliding track 3.

Figure 6:
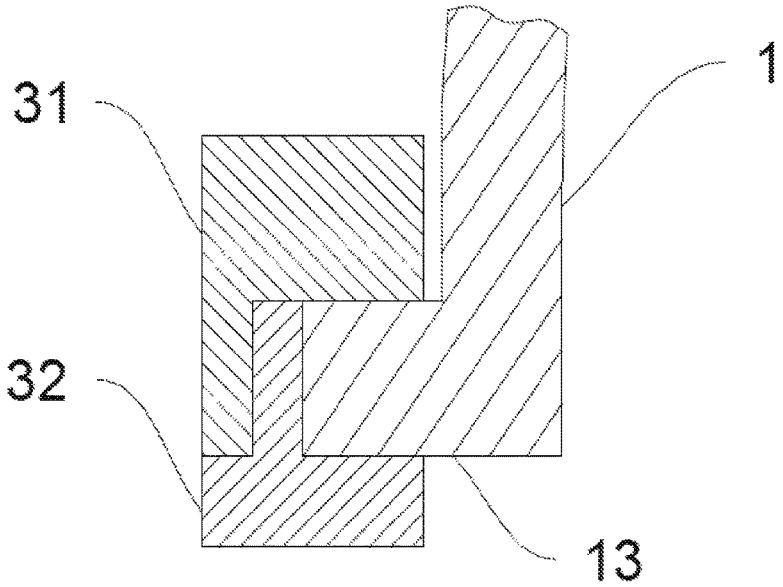
FIG. 6 illustrates a component connection example.

Please refer to FIG. 6, which shows a relation among components of the exterior housing 1, the block ring 13, a pressing ring 31 and a base 32 forming a moving structure.

Figure 7:
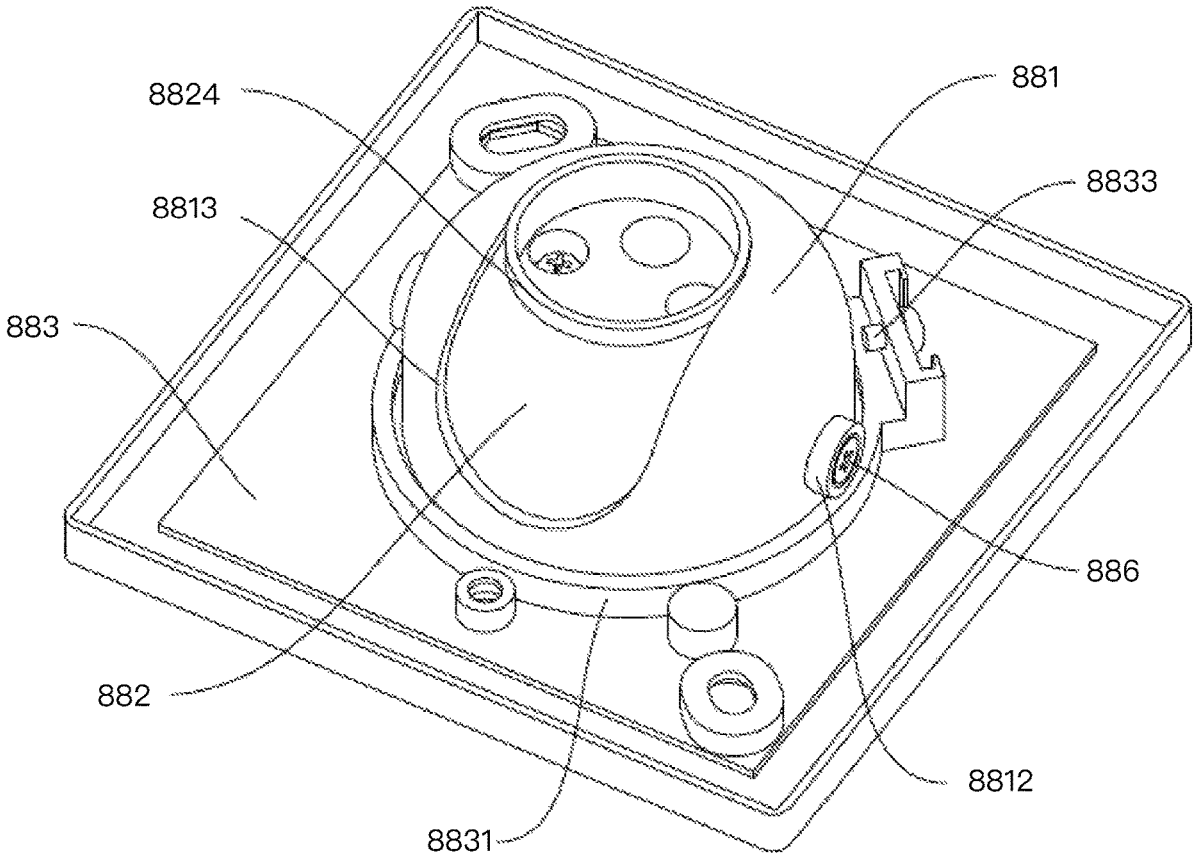
FIG. 7 illustrates another example of a lighting apparatus.

Please refer to FIG. 7, which shows another example.

In FIG. 7, the lighting apparatus has an exterior housing 881, an internal housing 882. There is a hinge 886 for the internal housing 882 to rotate with respect to the exterior housing 881. There is a block 8812 on the hinge 886 for the exterior housing 881 to move along the sliding track 8831. There is a stop structure 8833 for limiting a rotation angle of the exterior housing 881 with respect to the sliding track 8831. There is a sliding groove 8813 corresponding to the protruding block 8824 for providing and limiting a movement of the internal housing 882 with respect to the exterior housing 881. In this example, the sliding track is fixed on a rectangular shape platform 883.

Figure 8:
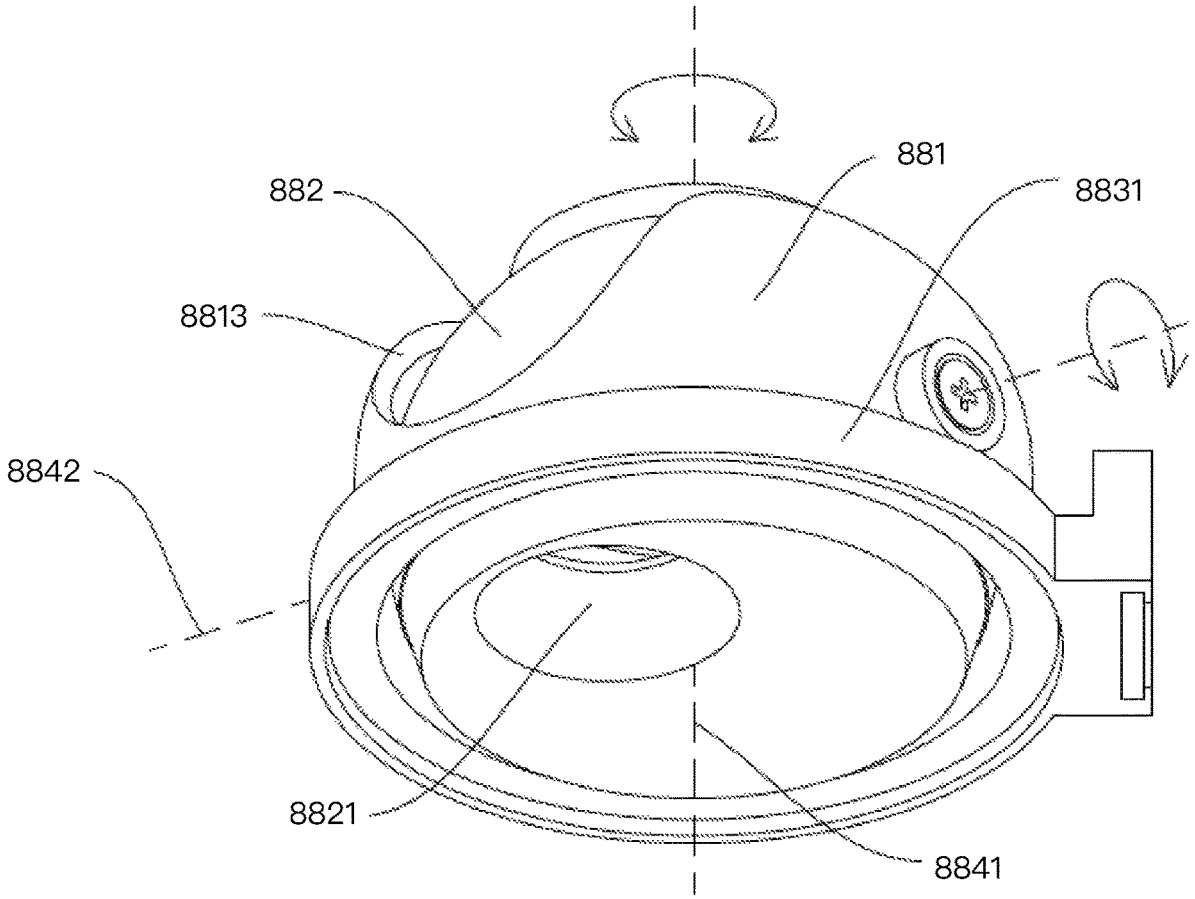
FIG. 8 illustrates a rotation diagram of a lighting apparatus.

Please refer to FIG. 8, which shows another view of the example in FIG. 7. Similarly, there are two rotation axes 8841, 8842 providing relative movements in two directions.

The light opening 8821 is smaller than the example in FIG. 1.

Figure 9:
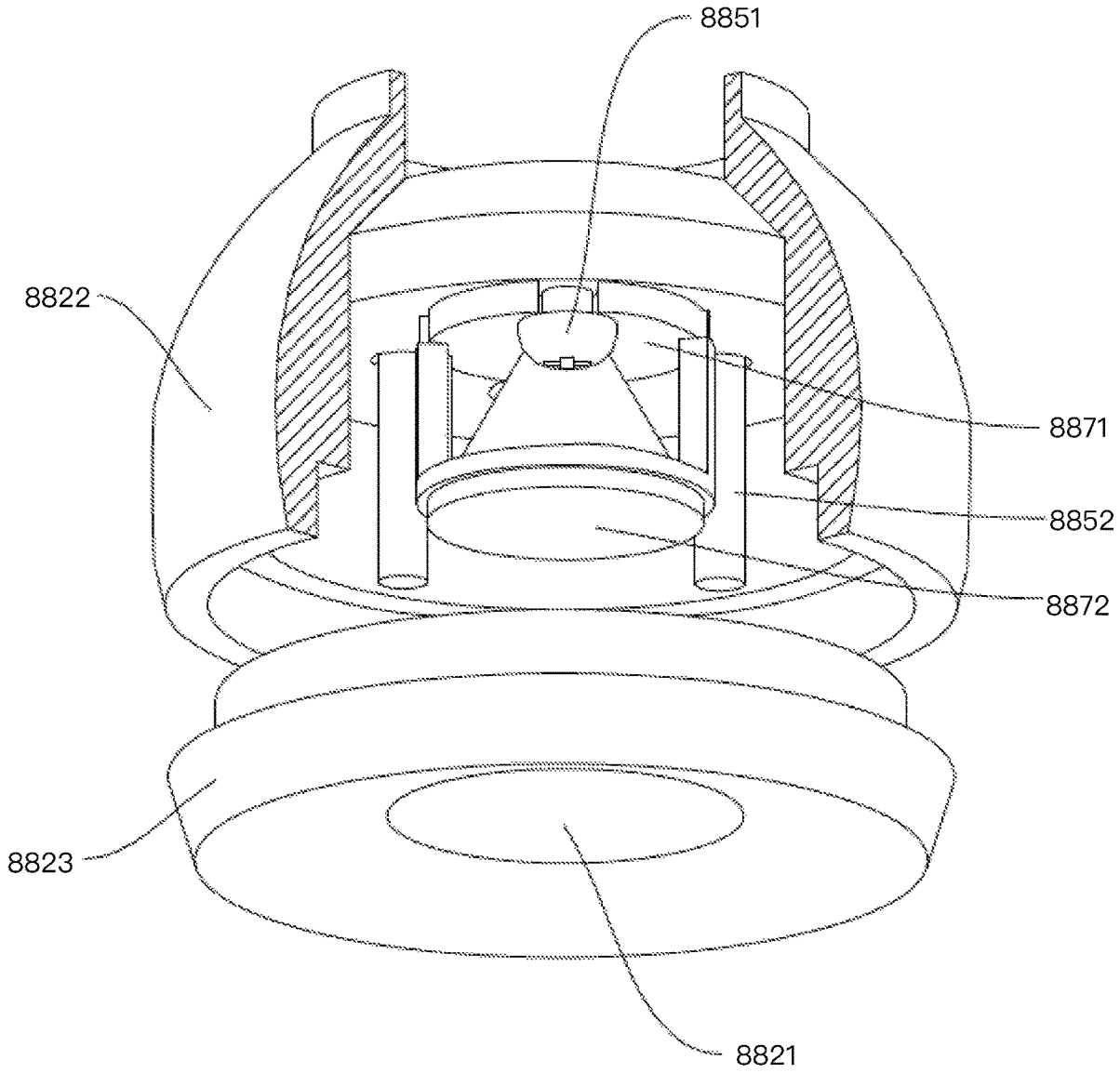
FIG. 9 illustrates another example of a lighting apparatus.

Please refer to FIG. 9, there is a sealing cover 8823 with the light opening 8821 for limiting a light scope defining a needed output light.

There is a lens 8872 with corresponding structures like a screws 8852 and 8851. The relative distance between the LED module 8871 and the lens 8872 may be adjusted as mentioned above in some embodiments.

Figure 10:
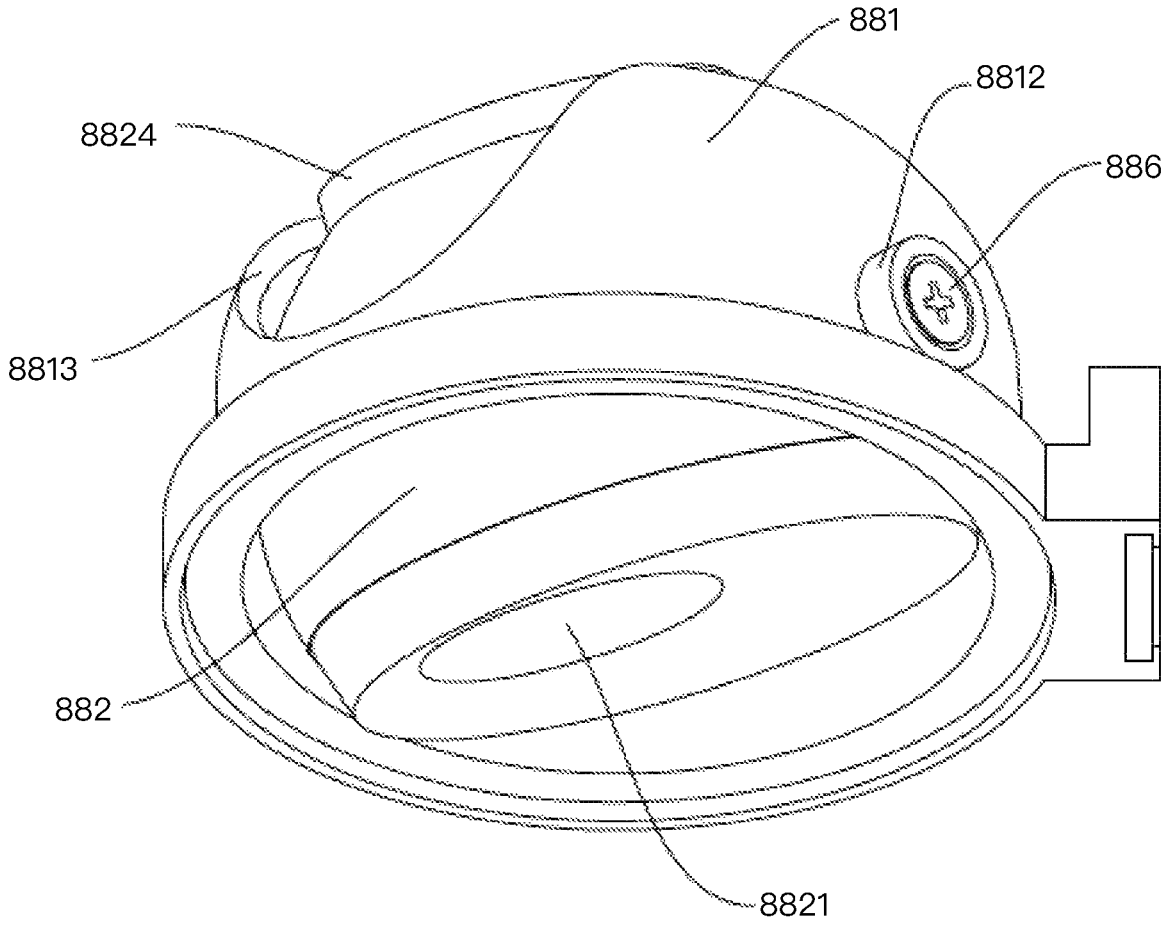
FIG. 10 illustrates a lighting apparatus embodiment.

Please refer to FIG. 10, which shows another view of the example in FIG. 9.

Figure 11:
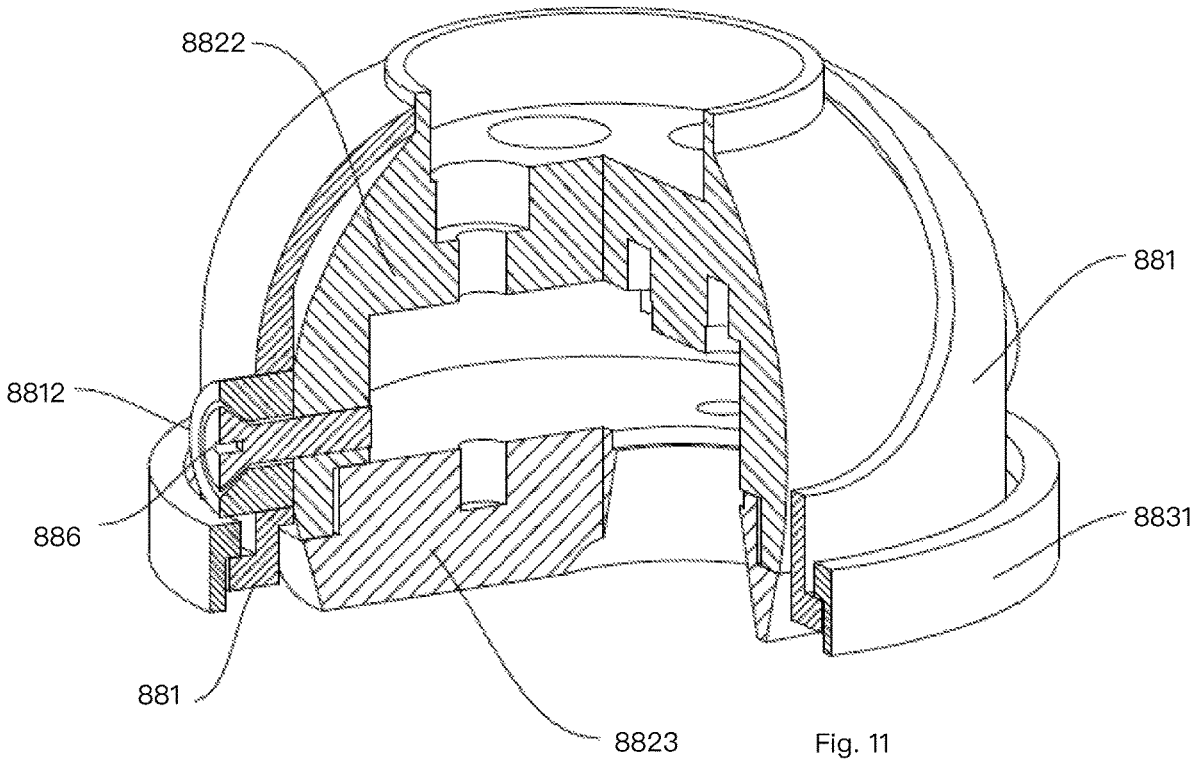
FIG. 11 illustrates a cross-sectional view of a lighting apparatus.

Please refer to FIG. 11, which shows an internal structure of the components mentioned above.

Figure 12:
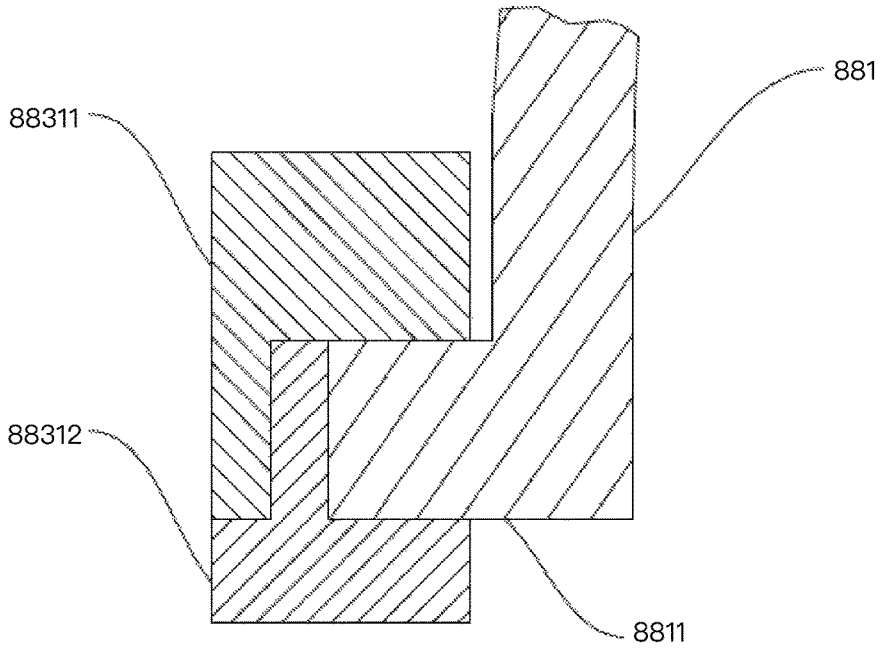
FIG. 12 illustrates a component connection in a lighting apparatus embodiment.

Please refer to FIG. 12, which shows the relation among the exterior housing 881, a block ring 8811, a base 88312 and a pressing ring 88311.

Figure 13:
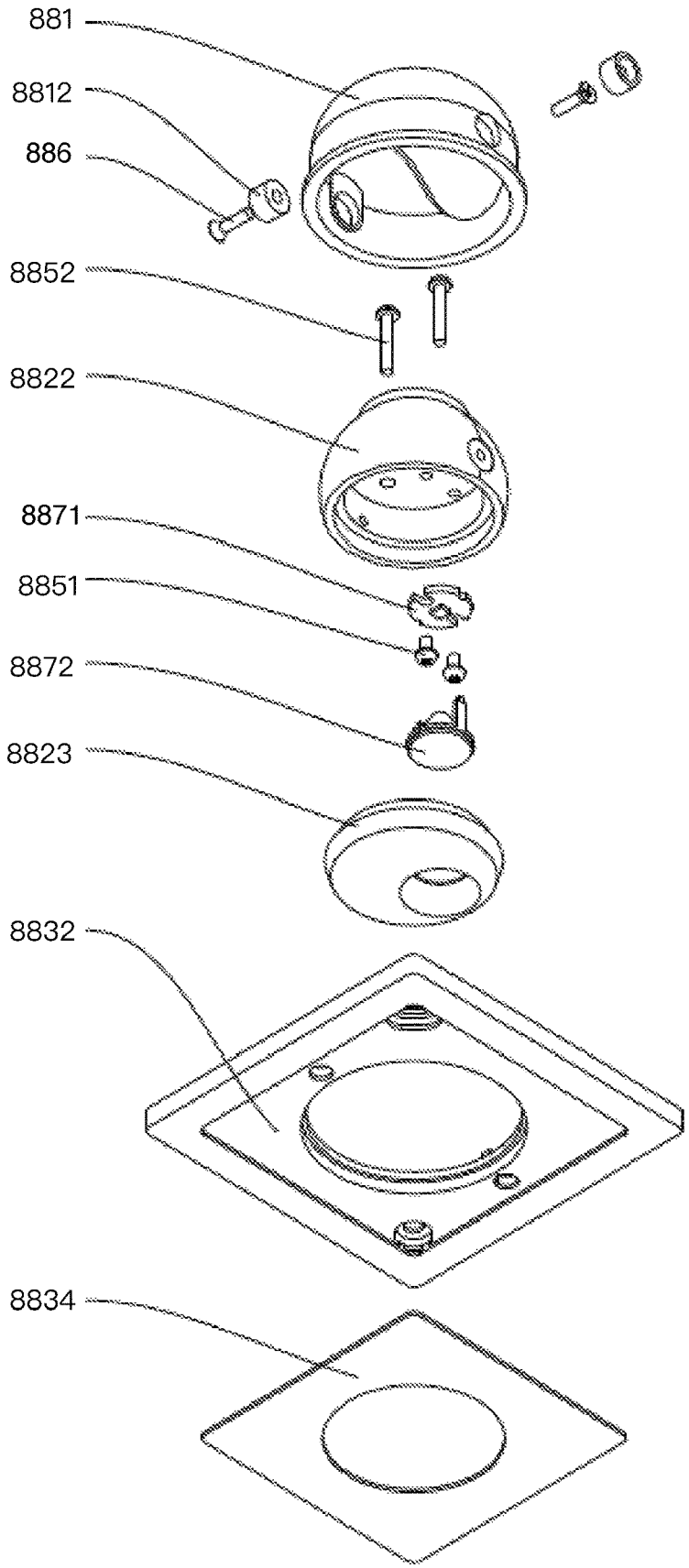
FIG. 13 illustrates an exploded view of a lighting apparatus.

FIG. 13 shows an exploded view of the components mentioned above.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source module comprising a LED module;

an internal housing having a light opening and a protruding block, wherein the light source module is fixed to the internal housing and a light of the LED module passes through the light opening;

an exterior housing having a sliding groove, wherein the exterior housing encloses the internal housing and allows the protruding block of the internal housing moving along the sliding groove to change a tilt angle of the light with respect to the exterior housing; and a sliding track for the exterior housing to move along the sliding track for further adjusting an output direction of the light, wherein the sliding track is a circular track.

2. The lighting apparatus of claim 1, wherein the exterior housing and the internal housing are semi-sphere structures.

3. The lighting apparatus of claim 2, wherein the sliding groove is a curve groove on the semi-sphere structure of the external housing.

4. The lighting apparatus of claim 1, wherein the sliding track has a segmenting structure for the external housing to move along the sliding groove segment by segment.

5. The lighting apparatus of claim 4, wherein the sliding groove has multiple segment positions for the protruding block to move and stay in one of the multiple segment positions.

6. The lighting apparatus of claim 1, wherein the sliding track has a stop structure to limit a rotation angle of the exterior housing with respect to the sliding track.

7. The lighting apparatus of claim 1, wherein the light source module has a lens for guiding a light direction of the light.

8. The lighting apparatus of claim 7, wherein the lens is manually moved to adjust a relative distance between the lens and the LED module to change a beam angle of the light.

9. The lighting apparatus of claim 1, further comprising a reflector movable for adjusting a relative angle between the light source and the internal housing.

10. The lighting apparatus of claim 1, wherein there is a hinge connecting the internal housing and the exterior housing for the internal housing to rotate with respect to the exterior housing.

11. The lighting apparatus of claim 10, wherein the hinge has a rotating shaft moving upon the sliding track.

12. The lighting apparatus of claim 1, wherein a camera module is attached to the internal housing.

13. The lighting apparatus of claim 1, wherein an optical sensor coupled to the light source for receiving an ambient optical parameter to dynamically adjust the light of the LED module.

14. The lighting apparatus of claim 1, wherein the light source module has a light beam source for emitting a light beam and a diffusion source for emitting a diffusion light.

15. The lighting apparatus of claim 1, wherein the sliding track emits a diffusing light.

16. The lighting apparatus of claim 1, wherein a timer is coupled to the light source module to adjust the light according to a time of the timer.

17. The lighting apparatus of claim 1, wherein the protruding block has a circular wall.

18. The lighting apparatus of claim 17, wherein a driver module is located inside the circular wall.

19. The lighting apparatus of claim 18, wherein the driver module has a driver box plugged to the circular wall.

* * * * *